United States Patent [19]

Roach et al.

[11] 4,387,537

[45] Jun. 14, 1983

[54] DEBURRING AND CLEANING MACHINE AND PROCESS

[75] Inventors: Maurice P. Roach; Russell D. Burkhart; James B. Meehan, all of Waterloo, Iowa

[73] Assignee: Iowa Engineered Processes Corp., Waterloo, Iowa

[21] Appl. No.: 259,660

[22] Filed: May 1, 1981

[51] Int. Cl.[3] ..... A24B 31/00

[52] U.S. Cl. ..... 51/17; 51/16; 51/7; 51/417; 51/217 S

[58] Field of Search ..... 51/16, 4, 7, 17, 417, 51/217 S, 317; 366/112, 122

[56] References Cited

U.S. PATENT DOCUMENTS

| | | | |
|---|---|---|---|
| 3,192,677 | 7/1965 | Johnson et al. | 51/417 X |
| 3,219,287 | 11/1965 | Weiss | 241/198 R |
| 3,265,366 | 8/1966 | Warner | 366/112 |
| 3,581,440 | 6/1971 | McKinney et al. | 51/17 X |
| 4,164,103 | 8/1979 | Hesse et al. | 51/417 |
| 4,174,591 | 11/1979 | Dupre et al. | 51/317 X |
| 4,326,362 | 4/1982 | Williams et al. | 51/417 |

*Primary Examiner*—James G. Smith
*Assistant Examiner*—Willmon Fridie, Jr.
*Attorney, Agent, or Firm*—Zarley, McKee, Thomte, Voorhees & Sease

[57] ABSTRACT

A deburring and cleaning machine and process designed to successfully clean work pieces such as castings, machined parts, and the like. The machine is characterized by a freely open work piece mounting plate movable in a predetermined pattern while simultaneously allowing free falling abrasion media to fall over, around and through the work piece. The method involves positioning a work piece in an open treating area, moving the work piece in a predetermined pattern through the treating area, and simultaneously free-falling abrasive media cascading over, around and through the work piece. The open treating area and the free-fall cascading of abrasive media provide improved cleaning and deburring of internal passageways, free falling abrasive media cascading, etc.

8 Claims, 3 Drawing Figures

DEBURRING AND CLEANING MACHINE AND PROCESS

BACKGROUND OF THE INVENTION

This invention relates to a machine and method useful in cleaning and deburring work pieces such as castings, machined parts and the like. Such work pieces as cast parts after removal from ceramic or permanent molds, typically have rough edges and/or "fins" which exist not only on the exterior surfaces, but also on internal passages and machined components or parts typically have sharp edges or "burrs" remaining from machining operations. These must necessarily be removed before the parts can be utilized as machine components. Prior techniques for cleaning work pieces such as cast parts have included blast cleaning with abrasion media such as steel shot, grit and the like; tumbling barrels filled with grinding media such as crushed stone, aluminum oxide, sand, carbide abrasive materials and the like; vibratory tubs wherein a tub is moved by an eccentric crank shaft with the work piece placed in the tub and filled with abrasive media, etc. Later, in the early 1960's, vibratory bowl techniques were employed wherein the work piece was placed in a container filled with media and cleaning fluid and shaken in a helical pattern within the confines of the bowl.

While all of the above mentioned prior art approaches to cleaning of work pieces have met with some success, they all have notable disadvantages. In particular, a primary disadvantage common to each of the systems mentioned above is that both the work piece and the abrasive cleaning media are contained in a confined space, the boundaries of which are defined by the vibrating container. The net result is that predictable patterns of movement for both the abrasion media and the work piece occur. This in turn results in abrasive media often becoming packed in the internal passageways of the work piece with the result being that the deburring and cleaning process is not effective, since portions of the work piece are insulated from the impacts of the abrasive media by packed abrasive media.

Accordingly, the primary object of the present invention is to overcome the above mentioned deficiencies with respect to prior art work piece deburring and cleaning machines and processes.

In particular, it is a primary object of the present invention in order to provide a deburring and cleaning machine and process which successfully prevents abrasive media compaction during the cleaning process.

Another object of the present invention is to provide a deburring machine and cleaning process for work pieces which allows the work piece to be effectively cleaned, smoothed and treated in a manner which is effective not only for external surfaces of the work piece, but more effectively cleans and deburrs internal passageways.

A still further object of the present invention is to provide a deburring and cleaning machine and process which, rather than packing the machine parts and the abrasive media inside of a container or receptacle, allows the abrasive media to free-fall through a wholly open area within which the work piece to be cleaned is moved.

A yet more specific object of the invention is to provide a deburring and cleaning machine and process which allows the abrasive media material to penetrate even the smallest and most difficult areas of the work piece, without compacting therein, and then falling to a catch pan for recycle and reuse.

An even more precise object of the present invention is to provide a deburring machine and process which allows simultaneous subjection of a work piece to a free-falling and cascading curtain of abrasive media while continually moving the work piece in an open area.

The method and means of accomplishing each of the above objectives, as well as others, will become apparent from the detailed description of the invention which follows hereinafter.

SUMMARY OF THE INVENTION

The apparatus comprises a substantially open frame work, with a vibratory means mounted in the frame work and a work piece mounting plate associated with the vibratory means for responsive movement of the mounting plate in a prescribed planar or spatial motion. The work piece is attached to the mounting plate which itself is positioned in the freely open portion of the frame work and means is provided to free fall cascading media over, around and through the work piece to be cleaned.

The process comprises positioning of a work piece in an open treating area, moving the work piece in a predetermined planar or spatial motion and simultaneously free-fall cascading abrasive media, around and through the moving work piece.

DETAILED DESCRIPTION OF THE INVENTION

As familiar to those of ordinary skill in the art of the designing of apparati for cleaning castings and other work pieces, a variety of differing "abrasive media" may be employed. The abrasive media itself does not form a part of the present invention, and it is understood that any of the conventional abrasive media may be used in both the machine and process of the invention. For example, conventional abrasive media may consist of alumina oxide, silicon carbide, hardened steel forms such as steel shot, ceramic forms such as silicon dioxide, granite chips and the like. Further, as is also well known, the abrasive media typically comprises the abrasive material mixed with a small amount of a water soluble bio-degradable cleaning compound, such as conventional synthetic detergents. Typically the amount of detergent solution may be from ½% to 2% by weight of the liquid employed. Emperically the amount is just enough to make the media wet or slightly dampened.

Figure 1:
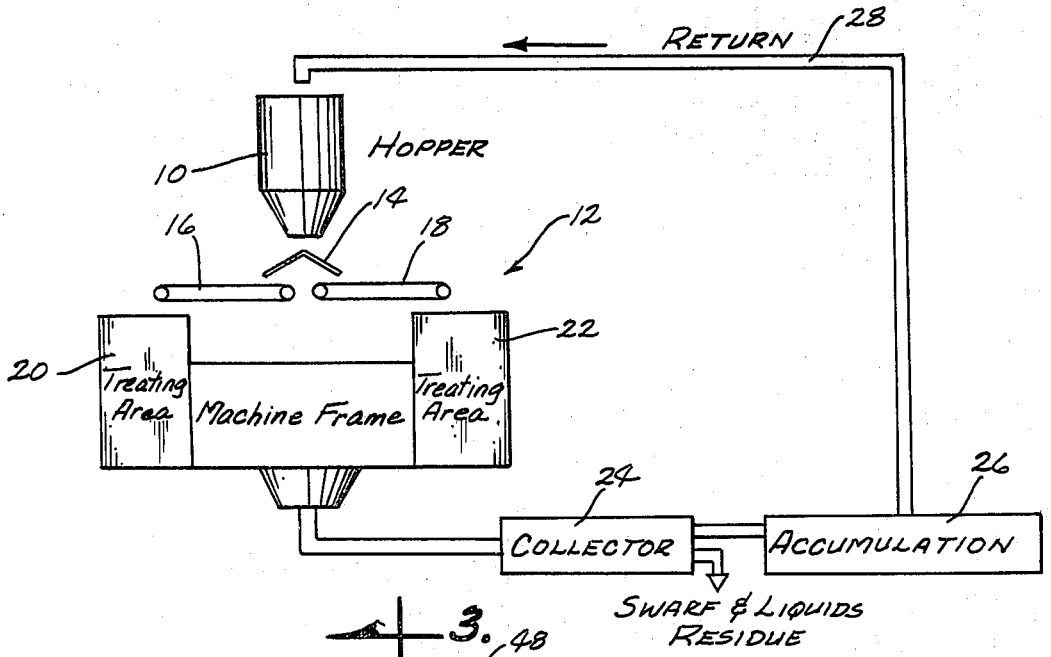
FIG. 1 is a flow chart showing in schematic block diagram fashion the complete movement of abrasive media through the machine and process of the invention, as well as recycle for subsequent treatment.
Figure 2:
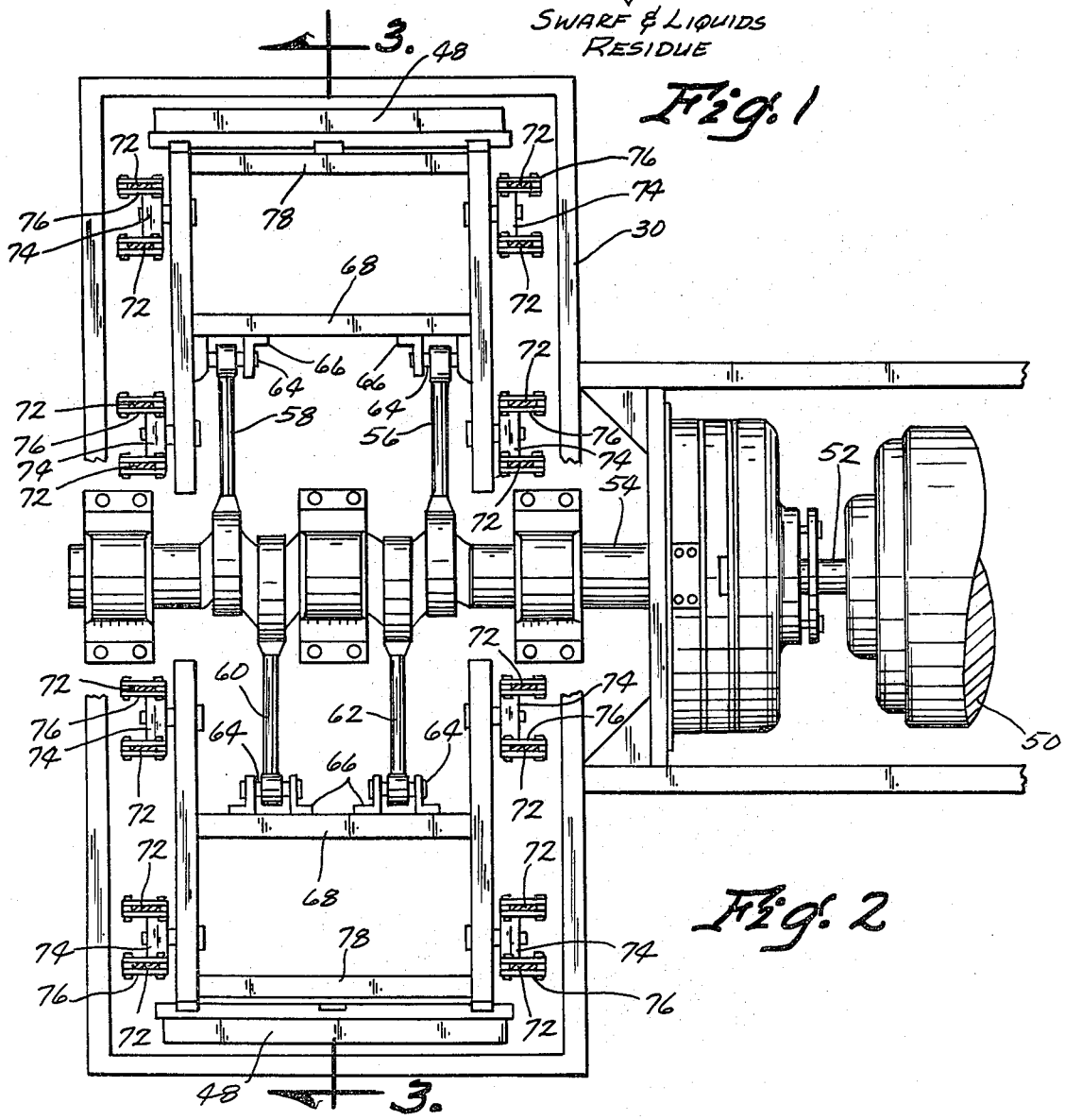
FIG. 2 is a plan view of the essential components of the deburring and cleaning machine.
Figure 3:
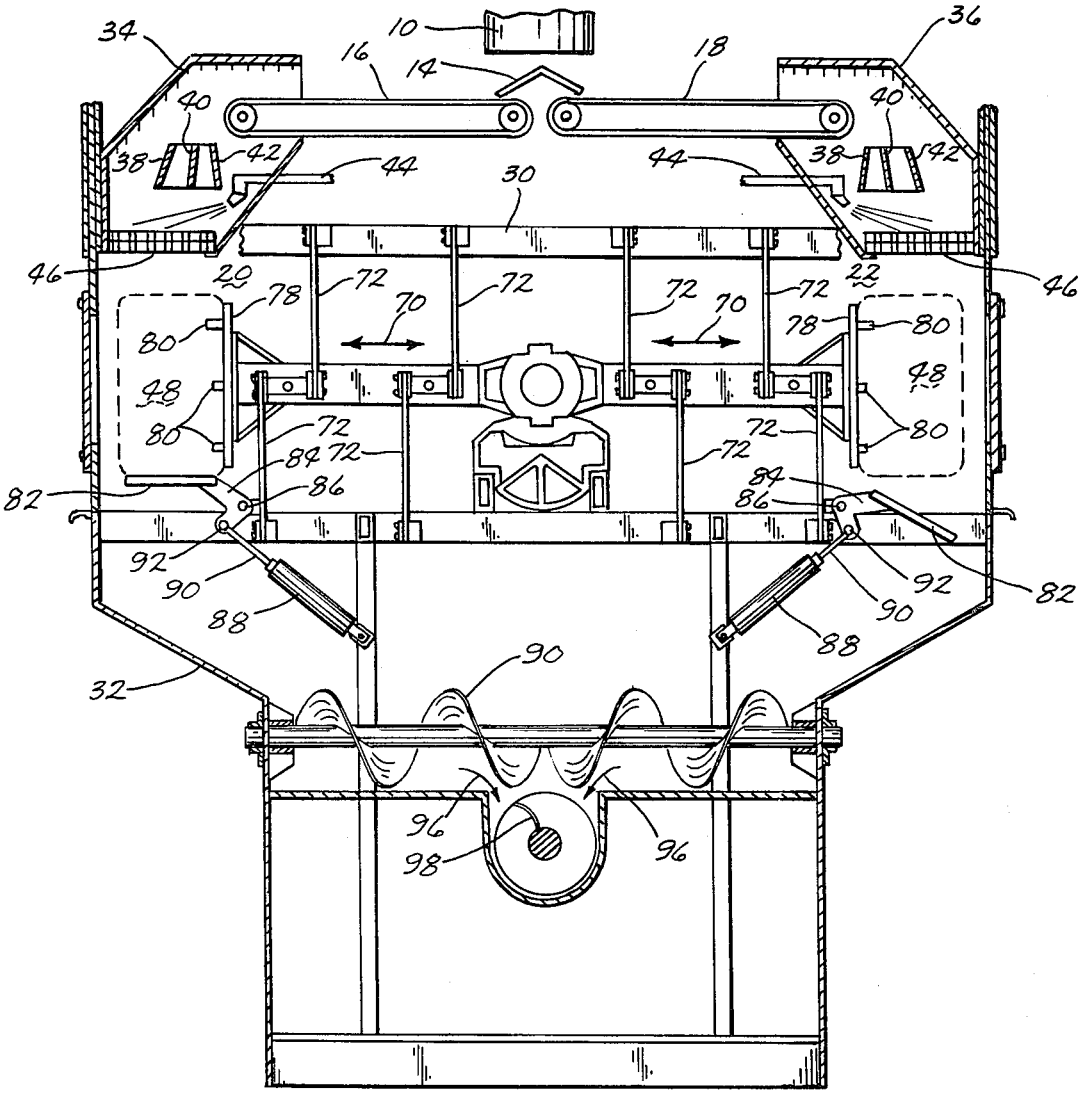
FIG. 3 is an elevated side view taken along line 3—3 of FIG. 2.

Before describing the apparatus and the process in considerable detail with reference to FIGS. 2 and 3, attention is first directed to FIG. 1 showing a block diagram schematic. Abrasive media as previously described along with a bio-degradable detergent composition are contained in hopper 10. The abrasive media falls from hopper 10, positioned above the apparatus of the present invention, generally depicted at 12. The abrasive media falls onto divider 14 where it is split into two portions, one conveyed to each side of the machine, as will be hereinafter described, by endless conveyor belts 16 and 18. The abrasive media then free-falls through an open area of the machine 12 labeled in the block diagram as "fixture", or in other words, machine framework. The abrasive media falls through the respective two treating areas 20 and 22, to a collector 24. Collector 24 separates "swarf", that is, dirty detergent and other residue from cleaned abrasive media accumulated at 26 which is recycled via return line 28 to hopper 10 for reuse. Having now described the flow of abrasive media through the machine in general detail, reference will be made to the specific embodiment of the invention illustrated in FIGS. 2 and 3.

A device according to the invention is comprised of a substantially open supporting framework depicted generally at 30. Surrounding the framework 30 is a cover sheet 32. The precise position and configuration of the frame members forming framework 30 is not critical and may be determined as needed for on-site construction of the device. The only important factor is that the framework be substantially open so as to be non-confining to abrasive media and that the framework provide support for hereinafter described vibratory means structural components, the work piece mounting plate structural components, and the structural components necessary for movement of abrasive media through the work piece treating area.

Turning now to FIG. 3, it can be seen that media falling from hopper or container 10 hits divider 14 wherein it is divided into two equal portions, one portion which falls on endless conveyor 16, and one portion which falls on endless conveyor 18. Conveyors 16 and 18 convey the media in opposite directions, to abrasive media flow regulating containers or vessels 34 and 36, which are mounted to supporting framework 30. Vessels 34 and 36 have media distribution plates 38, 40 and 42 mounted therein along the inside walls of vessel 34, the purposes of which are to catch falling media as it falls from endless conveyors 16 and 18 in order to assure effective distribution of the media prior to its gravity falling through the work piece. Thus, the media is divided into substantially equal portions falling to the area defined by dividers 38 and 40, and to the area defined by dividers 40 and 42. After falling through the dividers in vessels 34 and 36, the hereinbefore mentioned detergent composition is introduced by a sprayer 44 onto the free falling media. As will be apparent, for purposes of clarity, since the apparatus comprises two like portions on each side of the framework 30, like numbers will be utilized for both sides and a description given for only one with the understanding being that identical structure and processes are performed simultaneously on both sides of the machine 12. Sprayer 44 is, of course, connected to a convenient and conventional source for a liquid detergent and extends from that source into containers 34 and 36 positioned to spray detergent onto the abrasive media after the media falls through distribution plates 38, 40 and 42. After the detergent spray hits the abrasive media, it falls through aperture distribution plates 46 positioned at the bottom of vessels 34 and 36. The purpose of distribution plates 46, like the hereinbefore referred to dividers, is to direct the flow of the abrasive media to assure uniform distribution of the abrasive media as it cascades over and through the work piece. It can be seen that the flow of the abrasive media from conveyors 16 and 18 through the open framework 30 of the machine 12 is a free fall cascading movement through a substantially open area without the abrasive media being confined. This feature is an essential feature of the machine and the process.

After falling through aperture distribution plates 46, the media enters the previously described open treating areas 20 and 22. The work pieces 48 are positioned in the open treating areas 20 and 22 to allow them to be continually subjected to the free falling, non-confined abrasive media. The work pieces 48 are themselves supported in the treating area 20 and moved in a predetermined planar or spatial motion by means now described. The motive power means 50 drives shaft 52 which in turn, through appropriate connecting means not specifically numbered, drives crank shaft 54. Associatively connected to crank shaft 54 by conventional means are connecting rods 56 and 58, 60 and 62. Thus, it can be seen that rotary movement of crank shaft 54, caused by movement of driven motor shaft 52, will in turn cause reciprocal motion of connector rods 56 and 58 and 60 and 62. The outer ends of connector rods 56, 58, 60 and 62 are connected via pins 64 and brackets 66 to the work piece mounting support frames 68. Thus, frames 68 responsively move, looking at FIG. 2, when connector rods 60 and 62, 56 and 58 move reciprocally. Their movement, as depicted in the present device, is a reciprocal movement as illustrated by arrows 70 (see FIG. 3). In order to provide stabilization to the individual work piece mounting support frames 68, those are connected themselves to the overall device framework 30 via leaf springs 72 or other mechanisms which are yieldably resilient such that they stabilize the reciprocal movement of work piece mounting support frame 68. The leaf springs 72 are mounted in conventional fashion via linkage connectors of conventional construction 74–76. Thus, it can be seen that the work piece mounting support frame 68, hereinafter referred to as the driven frame, moves responsively to the power driven motor 50.

Motor 50 may be any conventional motive power means, but typically success can be achieved with a five horsepower to 15 horsepower motor rotating the crank shaft 54 at from 500 rpm to 10,000 rpm; however, it is understood that the precise motor, its horsepower and the revolutions per minute are not critical, those being readily determined and controlled for the individual work to be accomplished. Positioned at the outer end extremity of driven frame 68 is a work piece mounting plate 78. Work piece mounting plate 78 has fasteners 80, likewise of conventional construction, to allow the work piece 48 to be fastened to mounting plate 78. Positioned below the work piece 48 is a movable bottom support 82. Movable bottom 82 is connected to link 84 which is pivotally connected to frame 30 at 86. Also connected to frame 86 at a point remote from pivot 86, in pivotal fashion, is hydraulic cylinder 88. The cylinder rod 90 is pivotally connected to link 86 at 92. Thus, it can be seen that movable bottom 82 is movable from a supporting position shown in the left side of FIG. 3, with the cylinder 90 extended to a non-support position shown in the right side of FIG. 3, with the cylinder rod 90 retracted. The purpose of this supporting mechanism is to allow the work piece 48 to be supported in an at-rest position while it is attached via fasteners 80 to the work piece mounting plate 78. Thereafter, movable bottom 82 is retracted, as depicted in the right side of FIG. 3, so that it will not interfere with the free-fall of abrasive media through the open treating area 20.

Thus, it can be seen that the work piece 48 is mounted freely in a non-confined manner within the treating area 20, and 22, and it is reciprocated at a predetermined rate and pattern within the area. Simultaneously with this reciprocal movement through the treating area 20 free-falling and cascading abrasive media drops onto, around, over and through the work piece 48, and when the bottom 82 is moved away from the work piece 48, the abrasive media after falling through the work piece 48 falls to the bottom of the apparatus 12. In the bottom of the apparatus 12 is conveying auger or other mechanisms 94 which picks up the spent or used abrasive media and conveys it inwardly as depicted in FIG. 3 where it drops as indicated via arrows 96 to another auger 98 which conveys the abrasive media out from the bottom of the apparatus 12 towards the viewer in FIG. 3.

The precise motive power means and connecting means for augers 94, 98 are well known, and will not be specifically described herein. Spent media, or swarf, conveyed via augers 94 and 98 from the bottom of the apparatus 12 is then moved to a conventional collector 24 (see FIG. 1) wherein detergent, undesirable residue and other contaminants are removed and then the recycle process commenced.

It can be seen that in accordance with the present invention, the cleaning abrasive media free falls through an open treating area and onto the end around and through the work piece 48. Moreover, the work piece within the open treating area 20 and 22 is itself moved in a predetermined pattern via conventional vibrating means. The work piece supporting structure is designed so that it does not interfere with the free fall of abrasive media. Thus, unlike prior deburring and cleaning machines, with the present machine, it has been found that little or no compaction of abrasive media within the work piece occurs. This is so because the work piece itself is not confined and the abrasive media allowed to move in a free falling pattern. Thus, if there is a tendency for abrasive media to become compacted, the movement of the work piece will resist this compaction because of the free, open nature of the treating area. Moreover, because the abrasive media is free falling itself in an unconfined manner, it can successfully enter small, internal passages of the work piece 48 and effectively clean those. It therefore can be seen that the device of the present invention accomplishes all of its stated objectives.

What is claimed is:

1. A cascading deburring machine, comprising a substantially open framework;

vibratory means comprising a power means driving a shaft connected to a crankshaft which causes reciprocal movement mounted in said framework;

a workpiece mounting plate responsively connected to said vibratory means for responsive movement and reciprocal movement of said mounting plate within said open framework in a predetermined pattern; said workpiece mounting plate being positioned within said framework but in a freely open portion of said framework and cascading means positioned on said framework above said mounting plate to cascade free falling abrasive media within said framework and over, around and through interior portions of any article to be cleaned which might be mounted to said mounting plate.

2. The device of claim 1 wherein said cascading means is a hopper having an associated abrasive media distribution plate.

3. The device of claim 2 wherein an abrasive media collector is positioned on said framework below said workpiece mounting plate.

4. The device of claim 3 wherein said machine also includes means to clean said abrasive media and return cleaned media to said hopper.

5. The device of claim 1 wherein said vibratory means is one which provides reciprocal motion to said workpiece mounting plate.

6. The device of claim 1 wherein said vibratory means is a motor of variant horsepower which rotates from 5 h.p. to 15 h.p. rotating a crank shaft at from 500 rpm to about 10,000 rpm.

7. The device of claim 2 wherein said distribution plate has associated means for introducing small amounts of cleaning and wetting agent into said abrasive media.

8. The device of claim 7 wherein said distribution plate includes a sizing device and control means to control the rate of flow of cascading media.

* * * * *